United States Patent [19]

Hope et al.

[11] 4,011,904

[45] Mar. 15, 1977

[54] COMBINATION HEAT EXCHANGER AND BLOWER

[76] Inventors: Henry F. Hope, 3192 Huntingdon Road, Huntingdon Valley, Pa. 19006; Steven F. Hope, 2548 Wyandotte Road, Willow Grove, Pa. 19090

[22] Filed: Apr. 2, 1974

[21] Appl. No.: 457,273

[52] U.S. Cl. ..... 165/108; 122/20 B; 23/285; 165/121

[51] Int. Cl.[2] ..... F28F 13/06

[58] Field of Search ..... 165/108, 122; 122/20 B

[56] References Cited

UNITED STATES PATENTS

| | | | |
|---|---|---|---|
| 1,960,510 | 5/1934 | Ridgway | 165/166 |
| 3,352,298 | 11/1967 | Hope | 165/108 |
| 3,434,807 | 3/1969 | Ibing et al. | 165/108 |
| 3,523,761 | 8/1970 | Graham | 165/108 X |

*Primary Examiner*—Charles J. Myhre
*Assistant Examiner*—Theophil W. Streule, Jr.
*Attorney, Agent, or Firm*—Weiser, Stapler & Spivak

[57] ABSTRACT

A combination heat exchanger and blower unit suitable for connection into the breeching between a heater and the stack to admit hot flue gases into the unit. The flue gases enter a fan section wherein the hot flue gases and recirculated gases within the unit are accelerated by a fan. A helical coiled tube heat exchanger is positioned within the unit and is bombarded by the gases which are discharged by the fan. The turbulence created within the unit causes the heated gases to impact upon and to pass between the heat exchanger coils many times at high pressure. The repeated impacts of the heated gases upon the tube heat exchanger breaks down the boundary layer of stagnant gas surrounding the heat exchanger coils and results in greatly increased heat exchange efficiency.

15 Claims, 2 Drawing Figures

COMBINATION HEAT EXCHANGER AND BLOWER

BACKGROUND OF THE DISCLOSURE

The present invention relates generally to the field of heat exchangers, and more particularly, is directed to a combination heat exchanger and blower which is designed to reduce the lost heat at chimneys.

Prior workers in the field have employed heat exchangers of many types wherein heat from a first source is applied to a second medium. Most frequently, the presently available heat exchangers employ tubes which are surrounded by a heat absorbing medium such as water. Accordingly, when hot gases such as generated by a boiler, are directed through the tubes, the water surrounding the tubes can absorb some of the heat as it passes through the tubes to thereby heat the water, for other use such as feedwater to a boiler. Another type of heat exchanger that is commonly employed relates to an air preheater for use in large boiler plants. In such preheater designs, the flue gases are directed through a row or rows of coils prior to exiting through the stack to heat the combustion air before it enters the boiler. Thus, as the flue gases are directed to the stack, the heat of these gases which would otherwise be wasted is utilized to preheat the combustion air before it enters the boiler. However, it is noteworthy that the prior art types of heat exchangers suitable for use with boilers all relate to large installations and these designs cannot be utilized with small equipment such as a residential size heating unit.

Many similar types of installations are available and have long been utilized in the mechanical art field. However, most prior art heat exchangers are quite inefficient in operation and in function and cannot be designed to make economical use of the available heat, especially when applied to relatively small heaters.

The rate of heat exchange varies with the temperature differential between the heating medium and the liquid to be heated, with the length of time during which heat exchange may take place and with the velocity with which the heated gases are moved over the surface of the coils. It is well known that the rate of heat transfer by convection in a furnace will be considerably modified by the velocity of flow of the furnace gases. A boundary layer of stagnant gases blankets the heating surface of coils externally thereof in a manner to create an insulating factor inasmuch as these boundary layers are extremely poor conductors of heat. By increasing the velocity of flow of gases about the coils, the boundary layers can be modified to thereby increase the quantity of heat which may be transmitted through the boundary layer. Thus, as the boundary layer thickness decreases, the rate of convection increases.

SUMMARY OF THE INVENTION

The present invention relates generally to the field of heat exchangers and more particularly is directed to a heat exchanger incorporating an integral fan which is capable of directing fan forces through the heat exchanger tubing and to create high turbulence therewithin.

The present invention includes a housing within which a helical coiled tube heat exchanger is positioned generally near the outer periphery of the housing. Cold water enters at one end of the coil heat exchanger and exits at the other end after being fully treated within the housing. A fan of the multi-vane type receives hot flue gases from a heater and mixes these flue gases with recirculated gases from within the housing at the fan suction. The fan wheel discharges the hot flue gases and recirculated gases within the housing in a manner to create high turbulence whereby the heated gases pass through the heat exchanger coils many times at great impact, the impacts serving to break down the boundary layer of stagnant air surrounding the heat exchanger coils. The heat from the accelerated flue gases is absorbed by the water within the heat exchanger coils which can then be utilized for any purpose wherein hot water can prove beneficial.

In experiments conducted, it was found that heat transfer was five times as efficient by employing increased circulating velocity of the heated gases than without such fan forces. Experimentally, it has been found that with all other factors kept constant, when the volume of the air circulating within the heat exchanger was increased by a circulating fan driven by a ¼ horsepower motor from 160 lb./hour to 11,250 lb./hour, the heat transfer rate was increased from 1238 BTU/hour to 5056 BTU/hour.

Mathematical computation, based upon standard engineering equations of heat transfer in connection with systems of different conductors in series can be made to bear out in theory that which has been proved effective by experiment. In the section entitled "Transmission of Heat by Conduction and Convection," set forth at pages 4–92 to 4–99, Marks' Mechanical Engineers' Handbook, Sixth Edition, the following equation is set forth at page 4–99:

$$dq = \frac{ti - to}{(1/hidAi) + (x/kdA') + (1/hodAo)}$$

Where $dq$ denotes the rate of heat transmission in BTU per hour through a surface area dAo square feet;

$ti$ is the temperature (degrees F.) of air inside the furnace;

$to$ is the mean temperature (degrees F.) of water inside the water tubes; and $k$, $hi$ and $ho$ are film coefficients based upon thermal conductivity, viscosity, velocity, specific heat and shapes of the fluids and metal through which the actual heat transfer takes place.

There is therefore an object of the present invention to provide an improved combination heat exchanger and blower of the type set forth.

It is another object of the present invention to provide a novel combination heat exchanger and blower wherein a helical coil tube heat exchanger positions within a housing and hot gases from a heater are impelled at high velocity against the coils.

It is another object of the present invention to provide a novel combination heat exchanger and blower which includes a housing, a helical coil tube heat exchanger positioned within the housing, a centrifugal fan positioned within the housing interiorily of the coil to accelerate hot flue gases and recirculated gases to create high turbulence within the heat exchanger.

It is another object of the present invention to provide a novel combination heat exchanger and blower which includes fan means to direct hot flue gases and recirculated gases through a heat exchanger coil many times at great impacts to break down the boundary layer surrounding the coils.

It is another object of the present invention to provide a novel combination heat exchanger coil and blower wherein the blower through a cyclone effect creates high turbulence within the heat exchanger unit to greatly increase the rate of heat exchange from the flue gases to a medium contained within the coil.

It is another object of the present invention to provide a novel combination heat exchanger and blower that is inexpensive in manufacture, highly efficient in operation and trouble free when in use.

Other objects and a fuller understanding of the invention will be had by referring to the following description and claims of a preferred embodiment thereof, taken in conjunction with the accompanying drawings wherein like reference characters refer to similar parts throughout the several views and in which:

SUMMARY OF THE PREFERRED EMBODIMENT OF THE INVENTION

Figure 1:
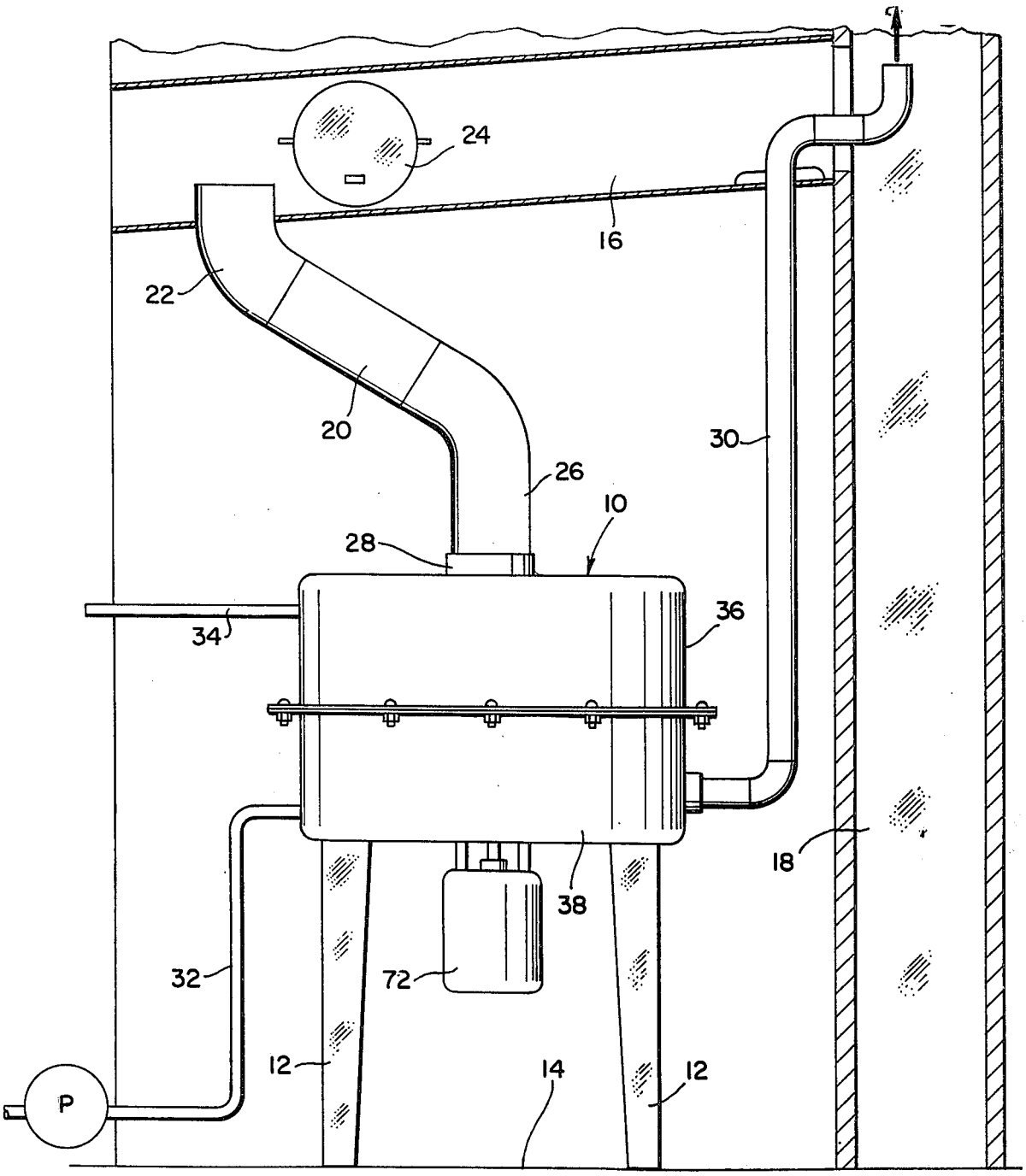
FIG. 1 is a side elevational view of the combination heat exchanger and blower of the present invention showing the mechanical connections.

Although specific terms are used in the following description for the sake of clarity, these terms are intended to refer only to the particular structure of our invention selected for illustration in the drawings and are not intended to define or limit the scope of the invention.

Referring now to the drawings, we show the combination heat exchanger and blower 10 which is suitable for use in conjunction with a conventional residential or commercial type heating boiler (not shown). The heat exchanger blower unit 10 includes suitable legs or other supports 12 to firmly mount the device upon the floor 14 in vicinity of the boiler breaching 16 and the smoke stack or chimney 18. The unit 10 receives exhaust flue gases from the breaching 16 by means of a small flue connector 20 which may be in the form of a three inch or four inch round smoke pipe. Preferably the inlet end 22 of the flue connector 20 connects into the breaching 16 intermediate the boiler (not shown) and the usual automatic vent control 24 to thereby receive flue gases from the boiler at the maximum exhaust temperature. The discharge end 26 of the flue connector 20 connects to the flue gas connector 28 of the heat exchanger unit 10 in conventional manner in a joint that is designed to prevent leakage at the junction. An exhaust vent 30 carries the cooled exhaust gases from the heat exchanger and blower unit 10 to the stack 18 for exhaust to atmosphere in the usual manner. A cold water return line 32 carries relatively cool water from the heating system (not shown) to the heat exchanger unit 10 for heating of the boiler feed water therewithin. A hot water line 34 carries the heated water from the combination heat exchanger and blower unit 10 back to the boiler (not shown). In this manner, considerable fuel savings can be realized at the boiler inasmuch as the fuel which is burned at the boiler for water heating purposes need not be employed to raise the boiler feed water temperature from the temperature of the water within the cold water return line 32 to the temperature of the water within the hot water line 34 inasmuch as this temperature rise is accomplished through the use of waste heat and therefore at no cost.

Figure 2:
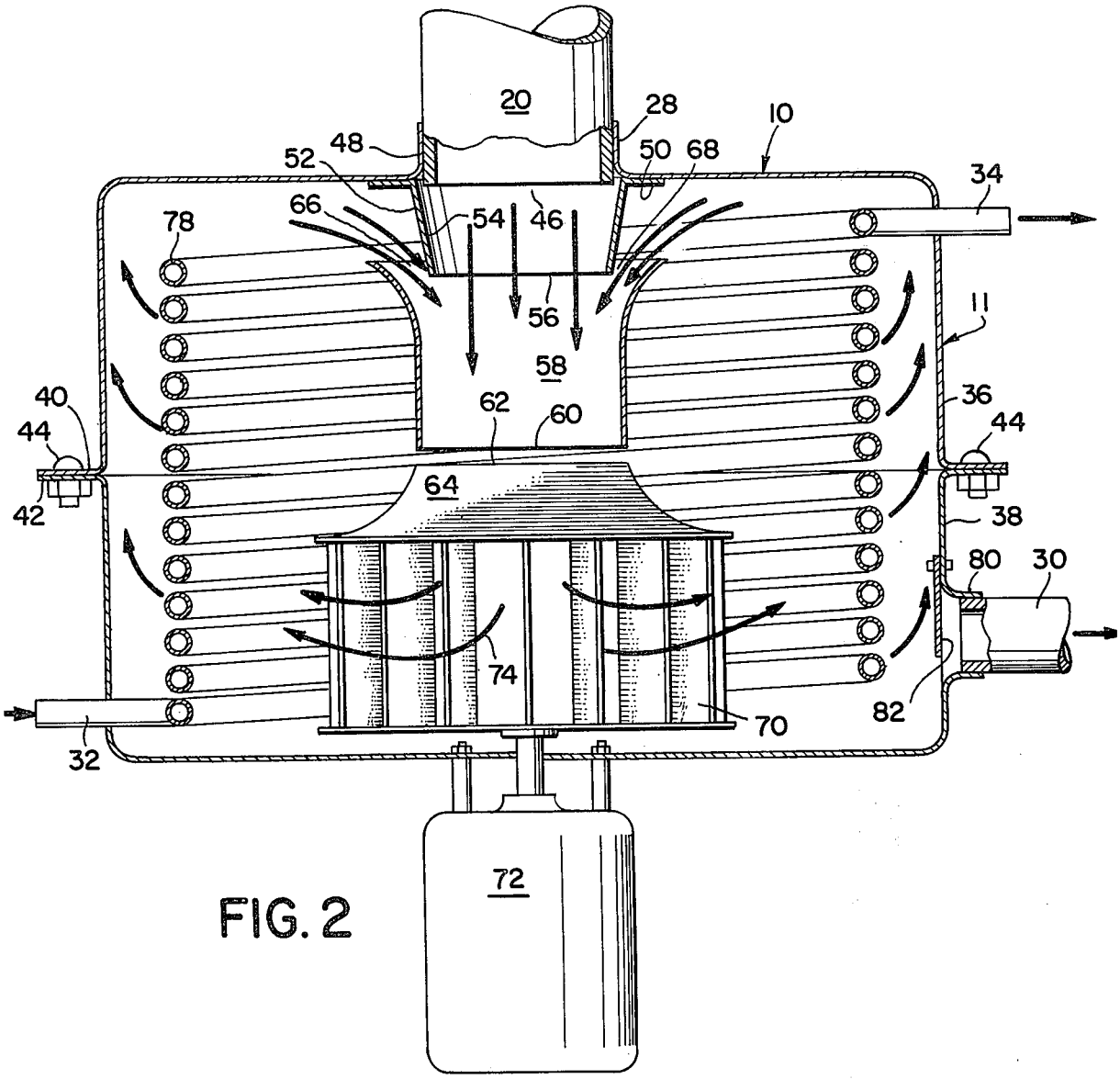
FIG. 2 is an enlarged, side elevational view of the heat exchanger and partially broken away to expose details of interior construction.

Referring now to FIG. 2, the heat exchanger and blower 10 includes a split housing 11 having an upper half 36 and a lower half 38 which each terminate inwardly in opposed flanges 40, 42 for conventional bolting together by a plurality of fasteners 44. The upper half 36 is provided with an axially aligned central opening 46 within which is positioned an air guide collar 48. The air guide collar 48 is preferably provided with a mounting flange 50 to facilitate connection to the upper housing half 36 in conventional manner. The collar 48 includes the flue gas vent connector section 28 which extends outwardly from the housing half 36 to receive the small pipe 20. An air guide section 52 projects interiorly of the heat exchanger 10 and is fabricated with inwardly inclined side walls which inwardly define a constricted nozzle 56 of diameter less than the diameter of the flue gas connector 28. The constricted nozzle 56 acts in the manner of a venturi to accelerate the incoming hot flue gases as they are introduced into the gas guide and mixing section 58.

The gas guide and mixing section 58 is formed to the general configuration of a hollow cylinder and terminates downwardly in a circular discharge 60 to introduce the hot flue gases and recirculated gases to the suction 62 of the fan 64. The gas guide and mixing section 58 is upwardly formed to provide an outwardly flared inlet 66 which receives the nozzle 56 of the flue gas connector 28 therein. The diameter of the flared inlet 66 is constructed greater than the diameter of the nozzle 56 to provide a peripheral recirculated gas inlet 68 about the periphery of the nozzle 56. Thus, hot flue gases from the boiler are introduced into the gas guide and mixing section 58 through the gas guide collar 48 and recirculated gases are introduced into the gas guide and mixing section 58 through the peripheral recirculated gas inlet 68. The restricted nozzle 56 serves to increase the flow of the hot flue gases to create suction forces to pull the recirculated gases into the gas guide and mixing section 58 through the peripheral gas inlet 68. Thus, the gas guide and mixing section 58 serves as plenum chamber or a mixing chamber wherein the recirculated gases from the gas inlet 68 are thoroughly mixed and diffused with the hot flue gases which are introduced into the gas guide and mixing section through the flue gas connector 28.

The fan 64 mounts upon the lower half 38 of the heat exchanger housing 11 and includes a conventional multi-vane type impeller 70. An electrical motor 72 mounts exteriorly of the housing halfs 36, 38 in conventional manner to rotate the impeller 70 when the unit is in operation. Energization of the electrical motor 72 turns the impeller 70 to pull the hot flue gases and the mixed, recirculated gases from the gas guide and mixing section 58 into the fan suction 62. The impeller 70 discharges the mixture of hot flue gases and recirculated gases interiorly of the heat exchanger 10 at greatly increased speed and at greatly increased static pressure. The mixture of hot flue gas and recirculated gas is discharged radially outwardly as indicated by the arrows 74. Due to the velocity of fan discharge and the high static pressure, the discharge gases create great turbulence within the housing interior 76. Due to the static pressure and the velocity of the fan discharge, a cyclone effect is created interiorly of the upper and lower housing halves 36, 38 causing the heated gases and recirculated gases to pass through the interior of the heat exchanger and to strike the helical coil 78 many times at great impact, thereby breaking the boundary layer of stagnant air which conventionally surrounds the heat exchanger coils. A one-half horsepower, 115 volts, a.c. motor has been found suitable for this purpose. It will be noted that the unit 10 is installed in a fail safe manner. Should the motor 72 fail to operate, no flue gases will be pulled into the unit 10 through the flue gas connector 28 and all flue gases will conventionally travel through the breeching 16 and then directly up the chimney 18 as if there were no unit 10 connected.

The exhaust vent 30 connects to an exhaust outlet 80 which is conventionally formed in the lower housing half 38. It is contemplated that the exhaust outlet 80 will be fabricated to a diameter which is smaller than the diameter at the flue gas connector 28 to thereby cause the build up of forces within the unit 10 for heat exhange purposes. Preferably, an outlet control damper 82 of the manual type is provided at the exhaust outlet 80 to permit variable restriction of the size of the outlet opening. In this manner, the build up of pressures within the interior of the unit 10 can be carefully controlled so that the device can be operated at the greatest possible efficiency. As seen in FIG. 1, the exhaust vent 30 connects into the chimney 18 to exhaust the spent flue gases which had travelled through the heat exchanger and blower unit in the usual manner. Preferably a separate chimney connection is employed for this purpose so as not to interfere with the normal flue connections and exhaust operations of the boiler (not shown).

Although we have described the present invention with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

We claim:

1. In a combination heat exchanger and blower apparatus having a housing defining a chamber, a hot gas inlet into the chamber, said gas inlet having guide means for directing the air flow into said chamber, a gas outlet from the chamber, a helical heat exchanger coil mounted inside the chamber and adapted to convey a heat exchange medium, and a fan having its impeller rotably mounted within the chamber, said impeller having a suction inlet for receiving a flow of gas, and a discharge outlet for discharging the gas in a lateral direction relative to the direction of gas flow into the suction inlet, the improvement comprising:

a conduit within said housing interposed between said hot gas inlet and the suction inlet of the impeller, said conduit providing a passageway with an inlet adjacent and in alignment with the hot gas inlet into the chamber, and an outlet adjacent and in alignment with the suction inlet of the impeller, said passageway directing the flow of gases from the hot gas inlet directly to the suction inlet of the impeller, said discharge outlet of the impeller being unobstructed by the conduit for permitting gas to be laterally propelled from the impeller directly into the chamber;

said heat exchanger coil being positioned about said conduit and said impeller to directly intercept the lateral flow of the propelled gas.

2. The apparatus of claim 1 wherein the fan impeller is positioned within the space defined by the coil.

3. The apparatus of claim 1 wherein said hot gas inlet is spaced so as to provide a communication with the chamber for receiving circulated gases from the chamber, whereby said passageway constitutes a plenum chamber for mixing the circulated gases with the inlet gases.

4. The apparatus of claim 3 wherein the hot gas inlet is in axial alignment with the inlet of the conduit passageway.

5. The apparatus of claim 1 wherein the outlet of the conduit passageway and the suction inlet of the fan impeller are in axial alignment.

6. The apparatus of claim 4 wherein the outlet of the conduit passageway and the suction inlet of the fan impeller are also in axial alignment.

7. The apparatus of claim 4 wherein the hot gas inlet includes a guide section means which forms a nozzle projecting into the passageway of the conduit for accelerating the flow of gas as it is directed into the passageway of the conduit.

8. The apparatus of claim 7 wherein the nozzle projects axially into the passageway of the conduit.

9. The apparatus of claim 7 wherein the inlet of the passageway of the conduit is an annular opening provided between the guide section means and the conduit.

10. The apparatus of claim 9 wherein the annular opening is in axial alignment with the hot gas inlet and the inlet of the conduit passageway.

11. The apparatus of claim 1 wherein there is no conduit for conducting hot gases extending beyond the fan impeller.

12. The apparatus of claim 1 wherein the discharge outlet extends substantially the full height of the impeller.

13. The apparatus of claim 1 wherein the fan is a centrifugal fan, thereby to accelerate to high velocity the gases which its impeller laterally propels.

14. The apparatus of claim 1 wherein the coil has spaced turns to permit gas circulation between turns.

15. The apparatus of claim 14 wherein the coil is spaced from the housing to permit gas flow between the coil and the housing.

* * * * *